United States Patent [19]

Gambardella

[11] 3,966,209

[45] June 29, 1976

[54] NUMBERS GAME

[75] Inventor: Anne Gambardella, Brooklyn, N.Y.

[73] Assignee: Lawrence Peska Associates, Inc., New York, N.Y. ; a part interest

[22] Filed: Apr. 10, 1975

[21] Appl. No.: 566,910

[52] U.S. Cl. ..... 273/130 R; 273/153 R

[51] Int. Cl.[2] ..... A63F 3/00

[58] Field of Search ..... 273/130 R, 130 A, 130 AC, 273/130 B, 130 C, 130 E, 131 D, 132, 135 R, 135 AD, 135 D, 136 E, 137 R, 153 R, 153 S, 156, 135 B, 136 R; 35/31 R, 31 D, 31 F

[56] References Cited

UNITED STATES PATENTS

| | | | |
|---|---|---|---|
| 1,061,999 | 5/1913 | Grondahl | 273/135 B |
| 2,368,896 | 2/1945 | Stewart | 273/130 B |
| 2,586,039 | 2/1952 | Heggedal | 273/130 B |
| 2,791,430 | 5/1957 | King | 273/130 R |
| 3,124,357 | 3/1964 | Preston | 273/130 R |
| 3,633,913 | 1/1972 | Solimene | 273/132 |

*Primary Examiner*—Richard C. Pinkham
*Assistant Examiner*—Harry G. Strappello
*Attorney, Agent, or Firm*—Richard E. Nanfeldt

[57] ABSTRACT

A number problem game includes a playing board having a top planar surface, seven boxes contained on the top planar surface, each box formed from nine squares, the nine squares arranged in three horizontal and three vertical rows intersecting each other, and a plurality of sets of playing discs with each disc having numbered indicia thereon, the indicia on each disc within a set being identical with the indicia on all other discs in that set, the indicia for each set differing from the indicia of every other set, the indicia of the respective sets including the respective numbers one to eight, each set including at least ten discs, the discs positionable in the squares of the seven boxes for forming fifty six multiple digit numbers of a three digit character in the seven boxes.

1 Claim, 5 Drawing Figures

NUMBERS GAME

SUMMARY OF THE INVENTION

My present invention relates to a unique and novel board game of numbers, wherein a player forms fifty six numbers of a three digit character from playing disc having numbered indicia ranging from one to eight.

A number of U.S. Pat. Nos. 3,659,851; 3,677,549; and 3,744,153 have employed various number games, but these aforementioned patents are non-applicable to my present invention.

An object of my present invention is to provide a mathematical board game of numbers that is educationally pleasing to all age groups, as well as serving as a positive means of entertainment, wherein numbers of a three digit character are formed.

Briefly, my present invention comprises an elongated rectangular shaped playing board having a top playing surface, wherein seven square boxes are printed on the top playing surface. Each box is subdivided into nine equally sized squares arranged in three horizontal and three vertical rows. Circular playing disc having numbered indicia ranging from one to eight are provided. The player forms eight members of a three digit character within each given box for a total of fifty-six numbers within the seven boxes, wherein no three digit numbers appears more than once.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
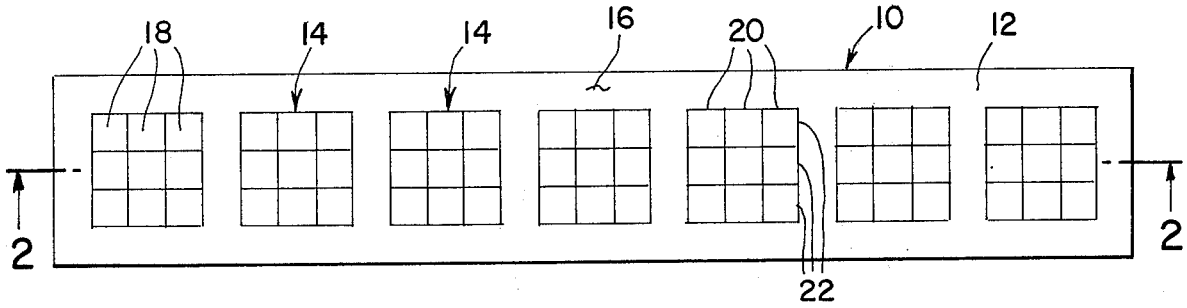
FIG. 1 illustrates a top planar view of a playing board of a game of numbers.
Figure 2:
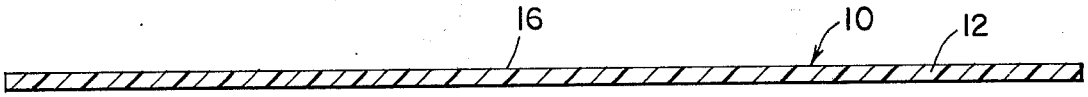
FIG. 2 illustrates a side view of the playing board taken along line 2—2 of FIG. 1.

Turning now descriptively to the drawings, in which similar reference characters denote similar elements throughout the several views, FIGS. 1, 2 show a game board 10 of a number problem game called "Tri-Compo Numbers Game." The game board 10 comprises an elongated rectangular-shaped playing board 12 having seven squares boxes 14 printed on a top surface 16 of the board 12. Each box 14 that is subdivided into nine equally sized squares 18 consists of three vertical rows 20 and three horizontal rows 22.

Figure 5:
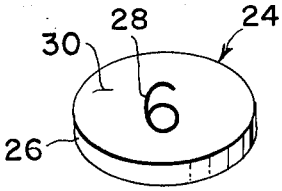
FIG. 5 illustrates a perspective view of one of the numbered playing discs.

FIG. 5 shows one of the number playing disc 24 formed from a circular disc member 26 having a numbered indicia 28 printed on a top lateral surface 30 of the disc member 26. The indicia 28 range in number from one to eight. At least ten numbers playing disc 24 of each indicia 28 are provided.

Figure 3:
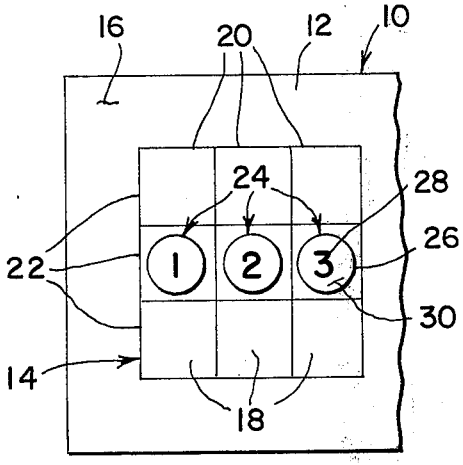
FIG. 3 illustrates a top planar sectional view of a playing box of the playing board.
Figure 4:
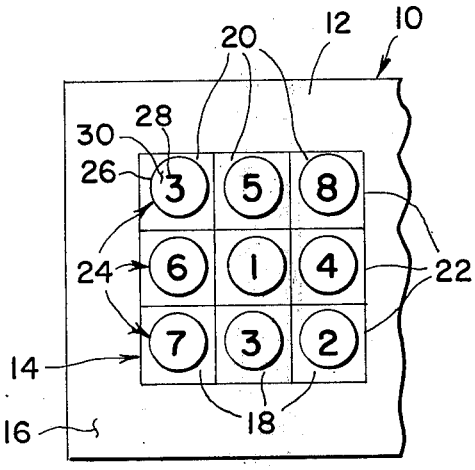
FIG. 4 illustrates a top planar sectional view of the playing box of the playing board, wherein the numbered playing discs are contained in the squares of the playing box.

The game is played as follows:

Each player is provided a playing board 12 and a plurality of number playing disc 24. The player places the discs 24 into all the squares 18 of all seven boxes 14 as shown in FIGS. 3, 4, wherein the objective of the game is to produce 56 numbers of a three digit character. Eight numbers of a three digit character are produced in each box 14, wherein three numbers are produced in the vertical rows 20, three numbers in the horizontal rows 22 and two numbers diagonally across the box. No number can be repeated in any of the three boxes. A number of a three digit character such as 122 or 313 is invalid, wherein the disc 24 having the same indicia 28 appears twice in the three digit number. The same player disc 24 can be used more than once within a box 14 as long as the disc is not repeated within the three digit number. Obviously, a number of variations of the game can be employed such as the length of time necessary to produce a given number of three digit numbers.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by letters patent of the United States is:

1. A number problem game, which comprises:

a. a playing board having a top planar surface thereon;

b. seven boxes contained on said top surface, each said box formed from nine squares, said nine squares arranged in three horizontal and three vertical rows intersecting each other; and c. a plurality of sets of playing discs with each disc having numbered indicia thereon, the indicia on each disc within a set being identical with the indicia on all other discs in that set, the indicia for each set differing from the indicia of every other set, the indicia of the respective sets including the respective numbers one to eight, each set comprising at least ten discs, said discs positionable in said squares of said seven boxes for forming fifty six multiple digit numbers of a three digit character in said seven boxes.

* * * * *